United States Patent [19]

Orrey

[11] 4,182,464

[45] Jan. 8, 1980

[54] TUBE SQUEEZER

[76] Inventor: Robert D. Orrey, 5575 East View Ct., Castro Valley, Calif. 94546

[21] Appl. No.: 910,142

[22] Filed: May 26, 1978

[51] Int. Cl.[2] ..... B65D 35/28

[52] U.S. Cl. ..... 222/98

[58] Field of Search ..... 222/95, 98–103; 401/152

[56] References Cited

U.S. PATENT DOCUMENTS

| | | | |
|---|---|---|---|
| 1,460,204 | 6/1923 | Maraffi | 222/98 |
| 1,927,278 | 9/1933 | Clark | 222/98 |
| 2,548,535 | 4/1951 | Iannone et al. | 222/98 |
| 2,840,273 | 6/1958 | McEwen | 222/98 |
| 2,932,431 | 4/1960 | Lipton | 222/98 |

*Primary Examiner*—H. Grant Skaggs

*Attorney, Agent, or Firm*—Ronald W. Redo

[57] ABSTRACT

A squeezing device for collapsible tubes containing soft paste, comprising in combination a wall-mountable bracket and various fittings for retaining two parallel rollers in close proximity to each other: the larger roller being hollow and having an axial slot on one side for holding the crimp-sealed end of tubes, and the smaller roller having an elastic surface to provide proper compressive force upon one or more windings of emptied tubing.

5 Claims, 4 Drawing Figures

TUBE SQUEEZER

BACKGROUND OF THE INVENTION

The invention relates in general to dispensers having means other than just manual squeezing or gravity to cause discharge of a receptacle's contents. More specifically, the invention relates to paste dispensers for collapsible tubes having rollers for evenly compressing out the tube contents.

PRIOR ART

Paste-containing tubes are often deformed in a random fashion that can trap material between folds and other irregularities. Also, sharply made bends can rupture a tube, causing leakage or air damage to the contents. In cases with volatile ingredients dispersed thinly along the length of a partly collapsed tube, a drying out of the ingredients occurs more quickly than when the contents are maintained in a uniform body as the tube is emptied. For the foregoing reasons, tube squeezers become an economical necessity.

An example of prior art is taught by U.S. Pat. No. 3,371,823, issued to Petersen. His device requires a lever be pressed against the tube and, simultaneously, rolling the device. Without manual skill, one could roll up an unsqueezed portion of the tube due to not applying force to the lever in time.

Another approach is illustrated in Borkenhagen U.S. Pat. No. 3,219,238 where two rollers are in use with a guide plate that must be in proper adjustment that depends upon wedges beneath the guide plate. While generally effective, the operation of the known prior art devices generally require manual skill for their use or frequent time-consuming adjustment.

SUMMARY OF THE INVENTION

The present invention comprises, in combination, a wall-mountable bracket, having a means for holding the ends of two rollers in close parallel proximity while allowing for their easy rotation. A recess is provided in the tips of the stationary bearings affixed to the inside tips of the bracket. These recessess allow the crimp-sealed end of a tube to be slid into the hollow center of the larger of said rollers along its axial slot. With the tube on the larger roller and the tube cap removed, the fingers of the user rotate the larger roller. As this rotation continues, the sealed end of the tube is drawn between the rollers where compression forwards the contents toward the tube nozzle. For dispensing precise quantities of paste, a slight finger squeezing of the tube can be made after the main part of the desired quantity is forced out by the compression of the rollers.

One object of the invention is to provide convenient tube storage that also allows quick, direct access to the tube nozzle.

A further object of the invention is to provide an efficiency of operation that eliminates the need for adjustments during any phase of operation.

An advantage of the invention related to its efficiency is the design simplicity that eliminates the need for instruction being given to the average user.

DESCRIPTION OF THE PREFERRED EMBODIMENT

Figure 1:
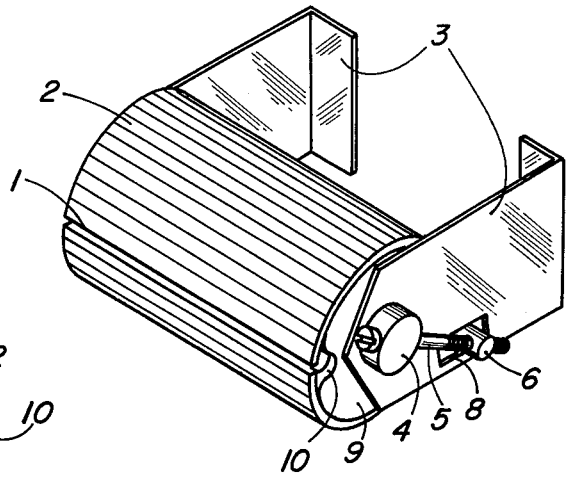
FIG. 1 is a perspective view of a first embodiment of the tube squeezer.

Referring now to the drawings in detail, wherein like reference numerals designate corresponding parts in all views, the present invention comprises, as shown in FIG. 1, a bracket having two L-shaped parts (3), a large roller (2), and a small roller (7), and other fittings to be described herein.

As shown in FIG. 1, the larger roller, 2, has an axial slot, 1, for retaining the tube's end. This larger roller, 2, is made of metal or a hard plastic section of pipe or tubing and is hollow with its interior ends rotating on bearings, 9. Additionally, the larger roller, 2, can be serrated axially on its exterior, (as in FIG. 1) to assist manual rotation. Both of the bearings, 9, are secured to the L-shaped sections of the bracket, 3, by glue or other means. A rod, 4, passes through the centers of the bearings, 9, and the bracket, 3 (see FIGS. 1 and 3), to provide structural rigidity.

Figure 3:
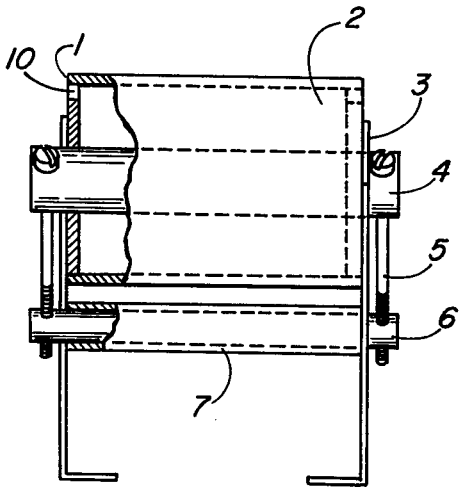
FIG. 3 is a cutaway top view of the first embodiment of the invention.

In FIG. 3 the smaller roller, 7, has an elastic surface to prevent tearing of a tube wall and to provide even compression when a tube has a minor surface flaw. Also shown in FIG. 3 is the nonflexible axle, 6, for the small roller, 7. The small roller, 7, can be effectively made from a section of plastic or rubber tubing that will slide onto the axle, 6.

Figure 2:
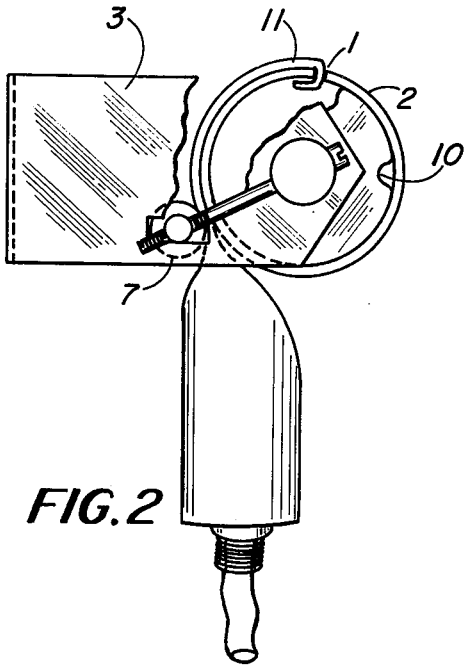
FIG. 2 is a cutaway side view of the tube squeezer, illustrating the positioning of a partially squeezed tube.

Adjustment screws, 5, used in the embodiment of the invention, shown in FIGS. 1, 2, and 3, adjust the spacing between the rollers. As shown in FIG. 1, the axle, 6, is bored and threaded in the ends that extend through the brackets, 3, to accommodate two gap adjustment screws, 5. The top of each adjustment screw passes through a hole drilled in the extending ends of the rod, 4, as shown in FIG. 3. As the adjustment screws are tightened, the small roller, 7, is drawn toward the larger roller, 2. Two gap adjustment slots, 8, are in the sides of the bracket, 3, to allow movement of axle, 6, on a plane roughly perpendicular to the axis of the larger roller, 2. The use of adjustment is only necessary for extra-long tubes or those having very thick-wall surfaces.

Figure 4:
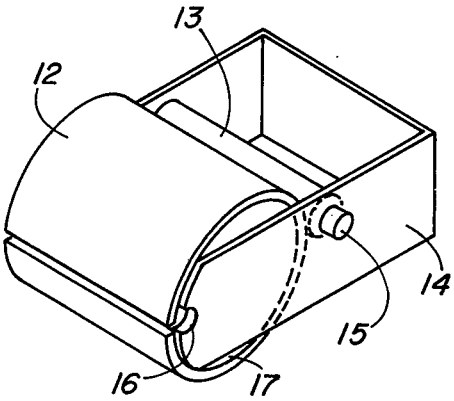
FIG. 4 is a perspective view of a second embodiment of the tube squeezer.

In FIG. 4 is a second embodiment of the same invention. This nonadjustable version is suitable for only tubes having a length equal to or less than the circumference of the hollow larger roller, 12, in FIG. 4. This embodiment of the invention is suitable for segments of the tube market having standardized size, like that in the toothpaste market. A tube with a length exceeding the larger roller, 12, can be used on it, but the last portion of the tube would have to be hand squeezed because the gap between rollers (12 and 13 in FIG. 4) cannot be adjusted to accommodate any tubing winding over its first layer.

The advantages of the second embodiment (FIG. 4) over the first (FIG. 1) are in the elimination of the adjustment screws (5 in FIG. 1) and the boring and threading of the small roller axle, 15 (6, bored and threaded, in FIG. 2). Also eliminated is the rod, 4, in FIG. 1 because the U-shape of the bracket, 14, provides enough structural rigidity without it. With no adjustment of the gap between rollers, the slots (8 in FIG. 2) are replaced with round holes for the axle (15 in FIG. 4). The snug fit of roller 13 onto axle 15 is needed to keep the axle, 15, from slipping out of the side holes in bracket 14.

A feature shown in FIG. 1 is the recess, 10, in the tip of bearing 9. In FIG. 4 the recess 16 is in both the tip of the bearing, 17, and the congruent portion of the bracket, 14. Both recesses, 10 and 16, are to facilitate sideways entry of the crimp-sealed end of the tube (11 in FIG. 2) under the axial slot (1 in FIG. 2) when it is aligned with the recess. (Alignment position for inserting tube is shown in FIG. 3.) The larger roller's axial slot (1 in FIG. 1) aids in holding the tube by being narrower than the widest dimension of the average crimp-seal. Embodiments of the invention can be made with no recess (10 in FIG. 1) or with a recess on both of the bearings, as shown in FIG. 3. Also, the bracket can be made to extend to the outer edge of the bearing (as shown by bracket 14 in FIG. 4) or only extend over a portion of the bearing (as shown by bracket 3 in FIG. 1).

For use of the invention, it is not necessary to attach it to any surface; however, screws or other means can be used to attach the bracket surface that is parallel to the rollers onto a wall or the like. The bracket, 3, in FIG. 1 is two sections of a ribbon of stress-resistant metal, and the bracket, 14, in FIG. 4 is made from a not-too-flexible plastic. The rod, 4, in FIG. 3 is round, but it can be square or any shape that provides structural rigidity because rod 4 does not rotate.

To empty a full or partly full tube, the crimp-sealed end of a tube (11 in FIG. 2) is inserted in the axial slot, 1, of the larger roller, 2. The insertion of the tube end can be directly into the axial slot, 1, or be slid on through the recess, 10, in a sideways fashion that brings the crimp-seal into the hollow center of roller 2. With the cap of tube 11 removed, the fingers of the user rotate the larger roller, 2, in a direction that brings the axial slot, 1, and the tube, 11, into contact with the smaller roller, 7. As rotation continues in the same direction, the tube, 11, is drawn between both rollers, 2 and 7 (see FIG. 2), where the even compression provided there completely forwards the paste contents toward and out the tube nozzle. To dispense precise quantities of paste, a slight squeezing of the tube, 11, by the fingers can be done after the main part of the desired quantity is compressed out by the action of the rollers, 2 and 7 in FIG. 2.

Changing tubes can be easily accomplished regardless of whether the one on the invention is empty or full enough to be put back on the roller, 2, at a later time. To remove the tube, 11, from the invention, the nozzle is pulled to unwind it from around the larger roller, 2. Said pulling causes a reverse rotation of the rollers to bring the axial slot, 1, into alignment with the recess, 10, thereby conveniently allowing sideways removal of the crimp-sealed end of tube, 11, through said recess.

While only preferred modifications of the invention are described, it is intended by their presentation to show that numerous modifications may be made to the invention without departing from the spirit of it.

I claim:

1. A dispensing device for manually emptying the paste contents from collapsible tubes, comprising in combination:

a rigid U-shaped bracket formed with two right-angle bends such that the side surfaces of the bracket will be perpendicular to the axis of rollers that are to be mounted therein; the side surfaces having, in identical positions, a rod hole and an axle slot;

a first roller having a rigid axle extending through both of said bracket axle slots and covered in the section that lies within said bracket side sufaces by elastic tubing and having threaded holes through said axle in both ends that extend outside of said bracket;

a hard tubular second roller extending between the bracket side surfaces; the second roller having an axial slot for receiving the lower portion of a collapsible paste-containing tube just above a crimp-seal of the tube;

two bearings of disc shape secured onto the facing sides of said bracket side surfaces and centered over said rod holes of said bracket and each bearing having a diameter slightly smaller than the inner diameter of said second roller whereby the second roller is mounted over the two bearings;

a recess in one of said bearings and a recess in a congruent portion of said bracket of a size to allow sideways entry of the crimp-seal on the collapsible paste-containing tube into the center of said second roller;

a rod extending through said rod holes of said bracket and parallel to said first roller and having holes through the ends that extend outside of said bracket;

a screw on each side of said bracket passing through the holes in said rod and threading into said axle ends and of a length such that the heads of said screws bear against said rod when tightened to pull said axle closer to said second roller.

2. A dispensing device as specified in claim 1 having a bracket that is split into two L-shaped sections of equal size and shape.

3. A dispensing device as specified in claim 1 where said second roller is metal and has axial serrations on its exterior to aid finger rotation.

4. A dispensing device as specified in claim 1 where said first roller is rubber.

5. A dispensing device as specified in claim 1 where said second roller is serrated axially.

* * * * *